US008439354B1

(12) United States Patent
Park et al.

(10) Patent No.: US 8,439,354 B1
(45) Date of Patent: May 14, 2013

(54) SELF CLEANING NUDGER ROLL IN A SHEET MEDIA PICK SYSTEM

(75) Inventors: Daniel C Park, Woodinville, WA (US); Christopher W Sneath, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/355,943

(22) Filed: Jan. 23, 2012

(51) Int. Cl.
*B65H 3/52* (2006.01)

(52) U.S. Cl.
USPC ..... 271/121

(58) Field of Classification Search ..... 271/258.01, 271/265.01, 121, 122, 124, 109, 147, 167; 15/256.51
See application file for complete search history.

(56) References Cited

U.S. PATENT DOCUMENTS

| | | | | |
|---|---|---|---|---|
| 4,843,436 | A * | 6/1989 | Evangelista et al. | 355/133 |
| 5,225,853 | A * | 7/1993 | Kobayashi et al. | 347/33 |
| 5,348,282 | A | 9/1994 | Choi et al. | |
| 6,131,899 | A * | 10/2000 | Nojima et al. | 271/121 |
| 2005/0200071 | A1 * | 9/2005 | Ikeda | 271/121 |

* cited by examiner

*Primary Examiner* — Thomas Morrison

(57) ABSTRACT

A fixed cleaning pad is configured and positioned such that that a media feed nudger roll will rub against it periodically to clean it of debris to improve mis-feeding performance.

11 Claims, 3 Drawing Sheets

SELF CLEANING NUDGER ROLL IN A SHEET MEDIA PICK SYSTEM

BACKGROUND

1. Field of the Disclosure

The present disclosure relates to a printing apparatus that includes a friction retard feeder, and more particularly, to an improved nudger system for use in such feeders that employs a self-cleaning nudger roll.

2. Description of Related Art

Nudger rolls are employed in friction feeders to move the top substrate(s) from a stack to a retard mechanism as a result of a net frictional force. The retard mechanism allows a single substrate at a time to pass thorough the mechanism. Included among nudger rolls are some that are constructed from an elastomeric material. These rolls have a failure mode of loss of suitable high friction coefficient due to contamination, paper dust, dirt build-up and wear. As a result, the nudger roll would need to be replaced or manually cleaned with an abrasive material or cleaning substrate. One attempt at addressing this problem a different way is shown, for example, in U.S. Pat. No. 5,348,282 which includes a self-adjusting nudger roll that comprises two rolls held together by a spring with one of the rolls being fixedly attached in a position which while the other acts as a rotating feed roll and simultaneously orbit about the surface of the other roll. The assembly automatically adjusts the normal force on substrates as the requirement of the feed force change and thereby reduces mis-feeds and multi-feeds.

Unfortunately, paper feeding problems created by contaminated nudger rolls are still present.

BRIEF SUMMARY

In answer thereto, provided hereinafter is an apparatus which uses a fixed cleaning pad that a substrate feeding nudger roll rubs against periodically to clean it of debris to improve mis-feeding and multi-feeding performance.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, media, or other useable physical substrate for printing images thereon, whether precut or initially web fed.

As to specific components of the subject apparatus or methods, it will be appreciated that, as normally the case, some such components are known per se' in other apparatus or applications, which may be additionally or alternatively used herein, including those from art cited herein. The cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
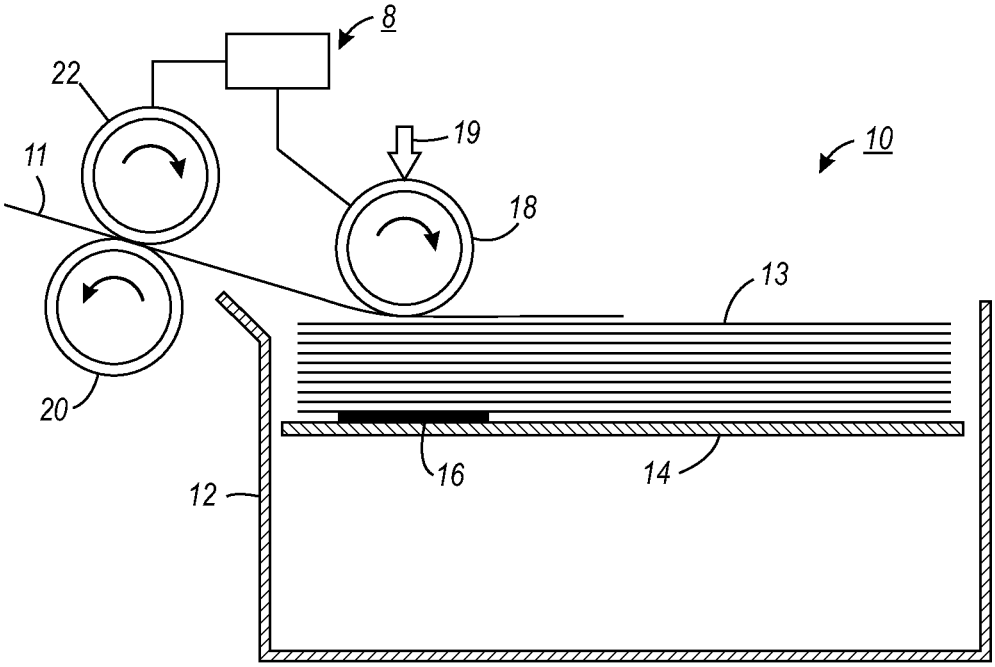
FIG. 1 (Prior Art)
FIG. 1 is a partial, profile view of a prior art retard feeding system showing a sheet being feed from a media tray by a nudger roll and into a retard roll pair.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to preferred retard feed system embodiments that include an apparatus for removing contamination from a nudge roll in the retard feed system embodiments.

For a general understanding of the features of the disclosure, reference is made to the drawings. In the drawings, like reference numerals have been used throughout to identify identical elements.

Referring now to FIG. 1, a conventional printer 8 such as, for example, shown in U.S. Pat. No. 5,348,282 includes a prior art retard feed system 10 for feeding sheets seriatim from a media tray 12. A media stack 13 is raised by lift plate 14 through conventional means so that the top sheet is in the proper position. Nudger roll 18 is biased against the media stack 13 with a spring (not shown) in the direction of arrow 19 so that predetermined force is established between the nudger roll and the top sheet of media. A cork pick pad 16 is positioned on top of lift plate 14 to apply friction to the bottommost sheet in the stack of media 13. The pick pad 16 has a coefficient of friction (COF) against the bottommost sheet of media such that the nudger roll is prevented from moving the entire stack of media out of the tray. Sheet 11 is shown having been partially fed from media stack 13 into a nip formed between retard roll 20 and feed roll 22 for further processing within printer 8.

Figure 2:
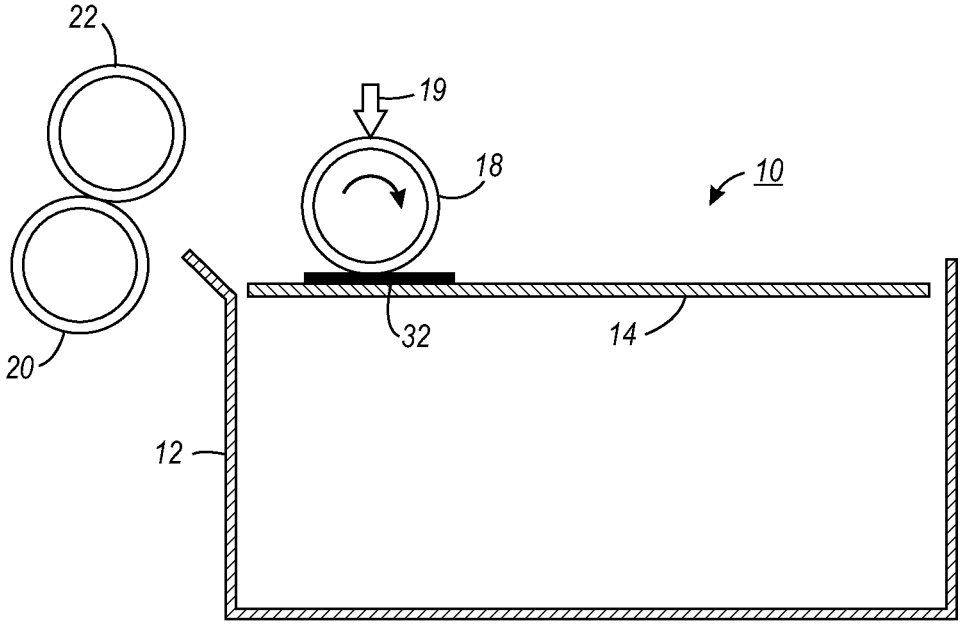
FIG. 2 is a partial, profile view of an improvement to the retard feeding system of FIG. 1 showing a nudger roll contacting a pick pad in accordance with the present disclosure.

FIG. 2 shows the media tray 12 after all of the media has been fed from it. The lift plate 14 has been raised so that nudger roll 18 is in direct contact with the pick pad 32. In accordance with one embodiment of the present disclosure and as an improvement over the prior art retard feed system of FIG. 1, nudger roll 18 is rotated against the pick pad 32 so as to abrade, and therefore, clean the roll. The pick pad material must be carefully chosen to result in the ability to abrade while still maintaining the proper COF. Many materials that have good abrasion properties (e.g., sandpaper) may also have a very high COF against media. If the COF of the pick pad is too high, then the nudger will not be able to provide enough drive force to overcome the drag force between the media and the pick pad in order to drive the last sheet of media out of the tray.

Figure 3:
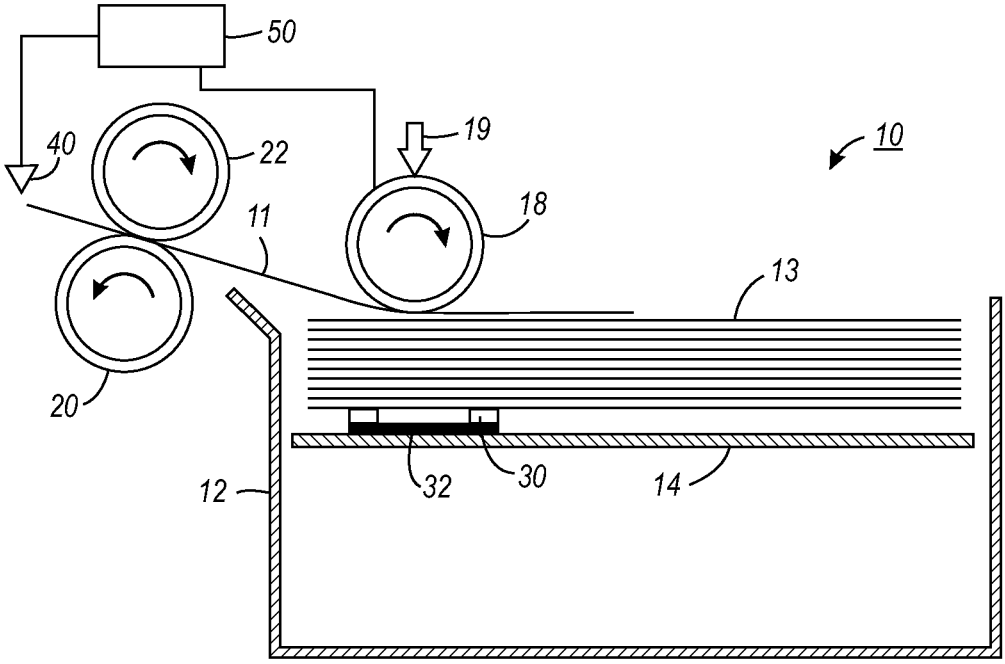
FIG. 3 is a partial, profile view of the retard system of FIG. 2 including an abrasive pad positioned on the lift pad of the media tray and a pick pad positioned on top of the abrasive pad.
Figure 4:
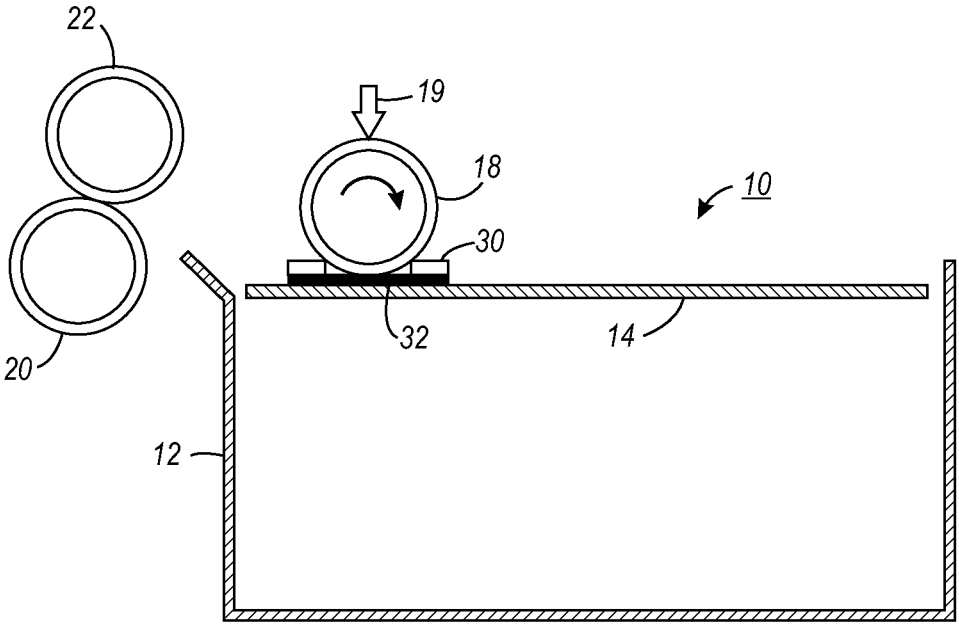
FIG. 4 is a partial, profile view of the retard feeding system of FIG. 3 after all sheets have been fed from the media tray.

Therefore, in order to accomplish the desired result, and in accordance with another embodiment of the present disclosure shown in FIGS. 3-5B, two ideal materials are chosen based on specific criteria: one material ideal for abrading the nudger roll, and another material for providing the proper COF between the pick pad and the last sheet of media, for example, pick pad 30 could comprise a cork material positioned adjacent the bottommost sheet in media stack 13 and abrasive material 32 could be sandpaper for abrading the surface of nudger 18. As shown in FIG. 3, a stack of media 13 rests on top of the pick pad material 30 which is affixed on top of the abrasive pad material 32 resting on lift plate 14 with the center portion of the pick pad material 30 cut out. A controller 50 of printer 8 in response a signal from sensor 40 controls the rotation of nudger roll 18. FIG. 4 shows the same configuration of abrasive pad 32 and pick pad 30 after all of the media has been fed from media tray 12. An opening in pick pad material 30 allows the nudger roll 18 to be loaded against the abrasive material 32 for cleaning.

Figure 5A:
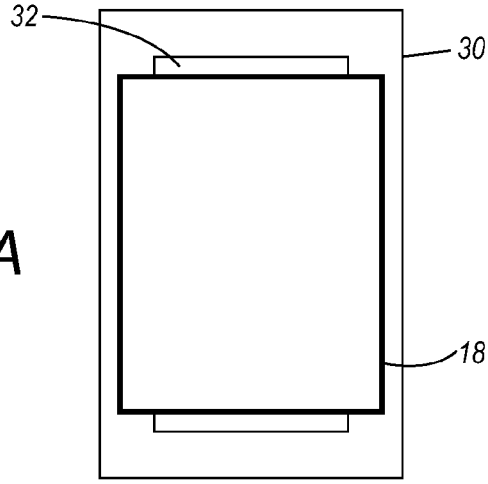
FIG. 5A is a partial, plan view of the retard feeding system of FIG. 4 showing the nudger roll, abrasive pad and a pick pad in accordance with the present disclosure.
Figure 5B:
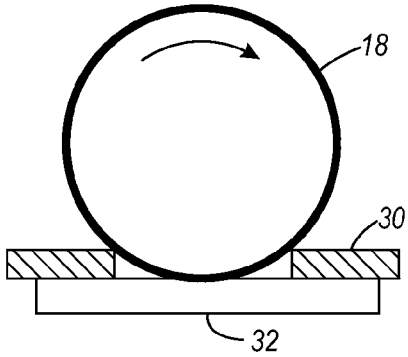
FIG. 5B is a partial, side view of the retard feeding system of FIG. 5A showing the nudger roll, abrasive pad and a pick pad in accordance with the present disclosure.

In FIGS. 5A and 5B, abrasive pad 32 and pick pad 30 are shown relative to an outline of nudger roll 18. The cutout of the pick pad material 30 is ideally rectangular to just allow nudger 18 to fit in the cutout in both the process and cross-process directions. This geometry has the advantage of utilizing the beam strength of the media in both directions to prevent the media from being loaded against the abrasive material.

With further reference to FIG. 3, another aspect of this disclosure is the ability to carefully control the cleaning action of abrasive material 32 in order to maintain optimum picking performance without prematurely wearing out the nudger roll. In practice, photo-sensor 40 just past the feed roller 22 detects the timing of a successfully fed sheet 11. The time from the beginning of nudger motion to the feed sensor 40 being blocked by the media represents the media pick time for picking a sheet from media stack 13. The media pick time is monitored on ongoing basis. If the media pick time regularly exceeds a pre-determined threshold, then controller 50 will request cleaning motion of the nudger roll at the next available time (tray empty). Alternatively, a feedback algorithm can be applied such that as the further the pick time grows; the longer the cleaning motion of the nudger will last when the tray is empty. Unlike other pick system cleaning methods, the nudger roll can be pro-actively cleaned before the performance significantly degrades such that any degradation is not noticeable by a customer.

Figure 6:
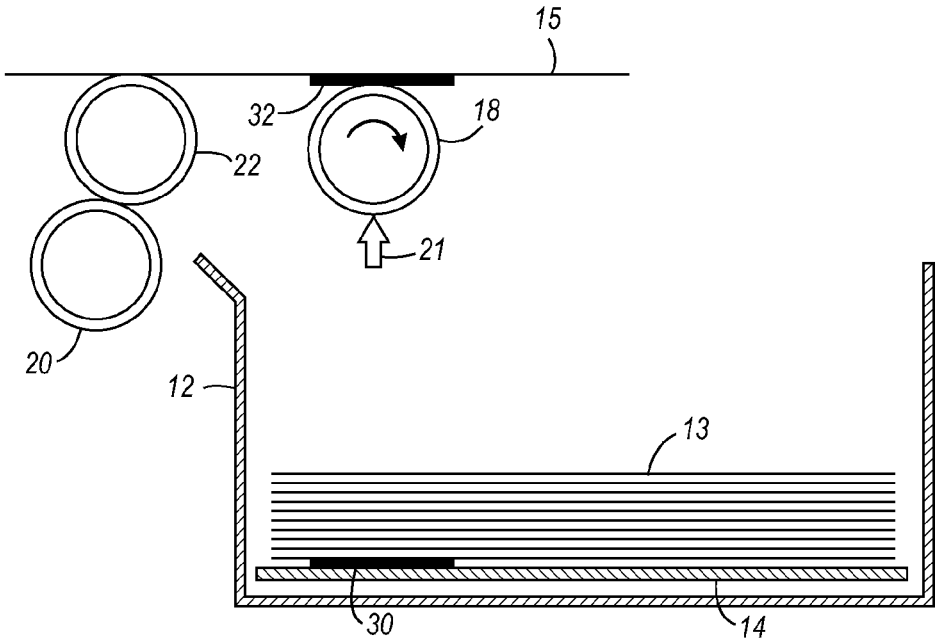
FIG. 6 is partial profile view of another embodiment of the retard feed system that includes an abrasive pad that is positioned above the nudger roll in accordance with the present disclosure.

An alternate embodiment in accordance with the present disclosure is shown in FIG. 6. Here, the abrasive material 30 is no longer coincident with the pick pad 32, but is placed on the supporting structure 15 of the feed mechanism directly above the nudger roll 18. When the media tray is removed, either to clear a jam or to add more media, a conventional mechanism (rack and pinion, etc.) that raises the lift plate 14 is released and the lift plate and media (if any) falls to its lowest position in the tray. In addition, the removal of the tray releases a cam that allows the nudger roll to be sprung upwards. In this case, the nudger roll is sprung up against the abrasive material 32. If cleaning of nudger roll 18 is required, then the machine controls, such as controller 50, will command the rotation of the roll against the abrasive material. This implementation has the advantage that the pick pad and abrasive pad materials and geometries can be chosen independent of another. This implementation has the additional advantage of allowing cleaning operation while media is still in the tray. For instance, some customers may seldom allow the tray to be completely emptied. For another instance, a nudger roll's COF may become degraded quickly with some medias and need to be cleaned before the tray is emptied. In this case, the roll can be cleaned while the customer is clearing a jam due to mis-feed as a result of degraded COF of the nudger.

In recapitulation, a pick system has been described hereinbefore as generally containing a pad of material that is present on the lift plate of a media tray directly under a nudger roll. The pick pad function is to provide the proper COF between the bottom sheet of paper in a media try and the lift plate. If the pick pad is replaced with an abrasive material, then the nudger roll can be intentionally abraded against the pick pad after the last sheet of media in a media tray is fed. Alternatively, an abrasive pad can be placed above the nudger roll. When the tray is removed, the nudger roll is sprung up against the abrasive pad such that the roll can be abraded while the media tray is re-filled. The abrasion will clean the nudger roll and restore its COF to like-new conditions. The rate of abrasion can be carefully controlled using two methods: (1) after each time the media tray is emptied, the machine software commands a specific amount of relative motion between the nudger and the abrasive pad; and (2) the machine software monitors pick times. Increasing times indicates a degradation of COF on the nudger. When the pick time exceeds a pre-determined threshold, a specific amount of relative motion between the nudger and abrasive pad is commanded the next time the media tray is emptied due to printing. The controller monitors mispicks and declares/performs a predetermined amount of relative motion between the nudger roll and abrasive pad the next time the media tray is opened or emptied.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A reprographic device including a feed mechanism that employs a nudger roll for advancing media seriatim from a media stack to a set of take-away rolls and a device for controlling contamination of the nudger roll, comprising:

a media tray for holding a stack of media to be fed therefrom;

a nudger roll for feeding media seriatim from said media tray;

a lift plate for raising said media from a bottom portion of said media tray into contact with said nudger roll;

a pick pad disposed on said lift plate and adapted to provide a predetermined coefficient of friction between a bottommost media in said stack of media and said lift plate, said pick pad including an opening therein;

an abrasive member positioned on said lift plate below said pick pad and adapted to provide a predetermined coefficient of friction between the bottommost sheet in said stack of media and said lift plate, and wherein said opening in said pick pad is configured to utilize the beam strength of said media in both directions to prevent said media from being loaded against said abrasive member; and a controller adapted to rotate said nudger roll a predetermined number of times against said abrasive member once all of the media has been fed from said stack of media and said nudger roll has entered said opening in order to clean contaminants from an outer surface portion of said nudger roll.

2. The reprographic device of claim 1, wherein said predetermined times said nudger roll is rotated against said abrasive member is determined by the number of sheets of media fed from said media tray.

3. The reprographic device of claim 1, wherein said nudger roll is rotated against said abrasive member each time said media tray is emptied.

4. A printer having a sheet feeding apparatus that includes a nudger roll contamination cleaning system, comprising:

a media tray for holding a stack of media to be fed therefrom;

a nudger roll for feeding media seriatim from said media tray;

a lift plate for raising said media from a bottom portion of said media tray into contact with said nudger roll;

a pick pad having an opening therein and adapted to provide a predetermined coefficient of friction between a bottommost sheet in said stack of media and said lift plate; and an abrasive member positioned on said lift plate and in direct contact with a bottom surface portion of and supporting said pick pad on said lift plate, said abrasive member adapted to provide an abrading surface for cleaning contamination from said nudger roll with said nudger roll positioned in said opening in contact with said abrasive member.

5. The printer of claim 4, wherein said pick pad includes said opening therein in a central portion thereof directly over and exposing said abrasive member.

6. The printer of claim 5, wherein said nudger roll is adapted to fit within said opening and contact said abrasive member once said media tray is empty for nudger roll contamination removal purposes.

7. The printer of claim 5, including a controller for controlling rotation of said nudger roll.

8. The printer of claim 7, including a feed roll set downstream of said nudger roll and a photo-sensor downstream of said feed roll set for detecting the timing of each successfully fed sheet.

9. The printer of claim 8, wherein said timing of each successfully fed sheet exceeding a predetermined threshold a predetermined number of times causes said controller to request a cleaning motion of said nudger roll at the next available time.

10. The printer of claim 8 wherein as said timing of each successfully fed sheet increases, the longer said cleaning motion of said nudger roll will last when said media tray is empty.

11. The printer of claim 8, wherein said opening in said pick pad is configured to utilize the beam strength of said media in both process and cross process directions to prevent said media from being loaded against the abrasive member.

* * * * *